US007066621B2

(12) United States Patent
Booty

(10) Patent No.: US 7,066,621 B2
(45) Date of Patent: Jun. 27, 2006

(54) DUAL-BEAM LANTERN-FLASHLIGHT

(75) Inventor: Donald J. Booty, Cave Creek, AZ (US)

(73) Assignee: Barbara Harari, Merrick, NY (US)

( * ) Notice: Subject to any disclaimer, the term of this patent is extended or adjusted under 35 U.S.C. 154(b) by 22 days.

(21) Appl. No.: 10/699,251

(22) Filed: Oct. 31, 2003

(65) Prior Publication Data

US 2005/0094388 A1 May 5, 2005

(51) Int. Cl.
*F21L 4/02* (2006.01)

(52) U.S. Cl. ..... 362/184; 362/191; 362/194; 362/217

(58) Field of Classification Search ..... 362/184, 362/190, 194, 195, 198–199, 202, 205, 217, 362/260, 227, 241, 800, 225, 200, 228, 191
See application file for complete search history.

(56) References Cited

U.S. PATENT DOCUMENTS

| | | | | |
|---|---|---|---|---|
| 4,321,657 | A * | 3/1982 | Hoi | 362/183 |
| 5,859,582 | A * | 1/1999 | Yuen | 340/326 |
| 6,184,794 | B1 * | 2/2001 | Tucholski | 340/636.14 |
| 2003/0095406 | A1 * | 5/2003 | Lebens et al. | 362/231 |

* cited by examiner

*Primary Examiner*—Thomas M. Sember
*Assistant Examiner*—Guiyoung Lee
(74) *Attorney, Agent, or Firm*—Galgano & Burke, LLP

(57) ABSTRACT

A dual-beam lantern-flashlight capable of emitting two light beams, including an elongated flashlight body having a front end and a rear end, a headlamp mounted in the front end of the body and disposed to emit a beam of light in a forward direction from the front end, a lantern body coupled to the flashlight body, the lantern body having a bottom end, and a lantern lamp mounted in said bottom end of said lantern body and disposed to emit a beam of light generally downwardly and normally relative to the beam of light emitted by said headlamp. The headlamp and lantern lamp when in use together create a single large area of continuous light around the feet and forward of the user.

27 Claims, 8 Drawing Sheets

DUAL-BEAM LANTERN-FLASHLIGHT

BACKGROUND OF THE INVENTION

I. Field of the Invention

The present invention relates to a portable lighting product. More particularly, the present invention relates to a dual-beam lantern-flashlight having a retractable lantern style handle, a first headlamp source, and a second down light source. The lantern-flashlight can be used with either or both beams in the on position.

II. Description of the Prior Art

Dual-beam flashlights and lanterns, and other multiple light source flashlights and lanterns, are well known in the portable lighting industry. These products sometimes combine "like" lighting sources, such as the Applicant's "Dual-Beam Flashlight", U.S. Pat. No. 5,558,430, (hereinafter the '430 flashlight); or U.S. Pat. No. 5,077,644, both of which employ standard incandescent lamps (i.e., "flashlight bulbs").

Alternately, these products combine different lighting sources, generally one of three types: light emitting diode ("LED"); hot cathode fluorescent lamp (commonly, a 6" long T5 [0.625" lamp diameter] bi-pin type lamp; or a cold cathode fluorescent lamp (CCFL), typically having a 100 mm length. In these various products, the combination of multiple light sources is often for different purposes. In many of these products, the light sources are used one at a time—such as Favor Light's™ Torch (i.e., a an incandescent lamp and CCFL light). With this unit, the user selects "Flashlight" mode for hand-held use, or "CCFL Light" mode for hands-free task lighting—but one cannot operate both lights simultaneously. Another example of this type of dual-beam lighting product is Streamlight's Syclone™ flashlight, which comprises an incandescent primary light source (krypton) for directing light forward and an LED secondary light source, both mounted in the same reflector, for close application lighting such as map-reading.

With other dual-beam lights, such as Rayovac's Workhorse™ dual-beam flashlight (since discontinued), or Zelco's various flashlights and/or flashlight/lanterns ("Kangaroo™ Light", "Bugless Lantern" and "Mini Fluorescent Lantern"), the user is able to operate both lights simultaneously. The Rayovac workhorse dual-beam flashlight contains no external mechanical operation of the secondary light source (i.e., it is "fixed"). The function of the secondary lights in Zelco's lamps differ somewhat, although all technically are able to operate both as a task light and downlight (e.g., for walking), similar to '430 invention. Other dual-beam lighting products offering simultaneously operable lighting sources follow one or the other of these formats; i.e., secondary light used as downlight/task light (e.g. '430) or secondary light used as alternate primary lamp (e.g., Syclone™ flashlight).

Similar to the style of the Zelco units is Applicant's aforementioned dual beam '430 flashlight. The purpose of this unit's separately and/or simultaneously operable secondary light was primarily as a downlight to illuminate the ground at the user's feet. The headlamp simultaneously illuminated the area in front of the user (out approximately 200+feet). The downlight feature used for the purpose of lighting the area around the feet is particularly useful in areas of rugged and/or dangerous terrain, or in emergency situations such as the aftermath of hurricanes, tornadoes, earthquakes, etc. (Other uses for the secondary light include hand-held map-reading, or changing tires with the unit in hands-free or free-standing mode, although the latter particularly was of limited usefulness, due to the small "footprint" of the unit for standing upright.

There are numerous disadvantages of these prior art dual beam flashlights. The incandescent light sources (krypton type) in the forward and downlight were not energy efficient. The result was limited continuous burn (i.e., lights on) time was only 90 minutes for each lighting source.

Incandescent light sources utilizing reflectors to drive the lamp beam forward are excellent for "long beam throw" (distances exceeding 100 feet forward), but are rather poor for close-range illumination. This is because the reflector focuses the beam out to a reasonable distance, but not at short range. In the case of the '430 flashlight, for example, the distance of the secondary light to the ground is usually only 24" to 36" (depending on the user's height). The result is a combination of annoying light patterns, shadows and rings. On rugged terrain particularly, its use is fair at best.

The area illuminated by the downlight was of a very small diameter. Thus, the user would only have a maximum 3 to 4 foot range forward illuminated by the downlight. For hiking in areas of dangerous animals, such as in deserts or mountainous regions, such a short range of illumination would be wholly inadequate for safe travel at night.

The combination of two focused incandescent light sources is unable to provide a "blended lighting effect". That is, there is a dark area (i.e., not illuminated by either or both of the lighting sources) of significant distance between the closest area of the ground illuminated by the headlamp, and that of the downlight.

Incandescent lighting sources have extremely limited "lamp life". The average life of a typical incandescent lighting source (i.e., incandescent lamp, or "flashlight bulb") is only 30 to 40 hours. This is due to failure of the lamp filaments, which are deliberately over-heated to create a glow, which in turn heats and illuminates the lamp gases such as krypton, xenon or halogen (unless a vacuum bulb without a gas is employed). Filaments are also susceptible to breakage with shock, such as occurs when a flashlight is accidentally dropped.

There were also functional limitations for hands-free and hand-held uses associated with the prior art flashlights and/or lanterns. As previously mentioned, the '430 flashlight offered other potential uses for its secondary downlight, besides the primary function of providing light at the user's feet. Firstly, it can be hand-held in an upright position, such as for close map reading. However, the lighting source—incandescent (krypton) lamp, exhibited all of the problems discussed previously, and thus detracted from any use of this lighting source at very close range.

Hands-free use standing upright on the unit's back end, was intended, e.g., for tire changing. Again, the problems of incandescent lighting at close range detracted from the light's effectiveness for tasks such as tire-changing, household repairs, etc. Even worse, the small "footprint" of the unit's base was only stable on relatively flat, horizontal surfaces not always available at roadsides for tire-changing, or other tasks.

SUMMARY OF THE INVENTION

Accordingly, it is an object of the invention to provide a dual-beam lantern-flashlight that solves the problems associated with the aforementioned prior art flashlights.

It is another object of the invention to provide a dual-beam lantern-flashlight which is relatively facile and easy to use and highly effective in use in either a hand-held or hand-free mode.

It is a further object of the invention to provide a dual-beam lantern-flashlight having a downlight lighting source which provides exceptionally uniform illumination, especially at close range.

It is an object of the invention to provide a dual-beam lantern-flashlight where the forward and downlight beams blends seamlessly together providing a continuous lighted area from below the user extending forwardly in front of the user.

It is yet another object of the invention to provide a dual-beam lantern-flashlight with lighting sources which are energy efficient and have a long lamp life.

Certain of the foregoing and related objects are readily attained according to the invention by the provision of a dual-beam lantern-flashlight capable of emitting two light beams, comprising an elongated flashlight body comprising a front end and a rear end with a headlamp mounted on the front end of the body and disposed to emit a beam of light in a forward direction from the front end, a lantern body coupled to the flashlight body, the lantern body having a bottom end and a lantern lamp mounted in the bottom end of the lantern body and disposed to emit a beam of light generally downwardly and normally relative to the beam of light emitted by the headlamp, wherein the headlamp and lantern lamp when in use together create a single large area of blended light around the feet and forward of the user.

Preferably, the flashlight body is slidably coupled to the lantern body for movement of the flashlight body between a raised and lowered position relative to the lantern body. The dual-beam lantern-flashlight headlamp desirably comprises at least one LED lamp and the lantern lamp comprises a cold cathode fluorescent lamp. Most desirably, a front cap is threadably receivable on the front end of the flashlight body, an LED lamp is mounted in the cap, a reflector is positioned behind the lamp and a lens is mounted in the cap in front of the lamp. Preferably, the headlamp comprises four LED lamps arranged in a cluster pattern.

Most advantageously, the lantern body further comprises a reflector mounted behind the lantern lamp and a lens mounted in front of the lantern lamp. Preferably, the lens has a light texture pattern for diffusion. Most desirably, the lantern body has an upper battery compartment and a removable battery cover is provided on the rear side of the lantern body for access to the battery compartment.

In a particular preferred embodiment of the invention, a power switch is provided on the flashlight body for providing power to the headlamp and the lantern having a plurality of switch positions for enabling the headlamp and said lantern lamp to emit light individually or simultaneously. Most desirably, the lantern body has a pair of spaced apart, upstanding arms having downwardly extending channels formed therein and the flashlight body has a pair of spaced apart, downwardly extending flanges slidably received in the channels to allow movement of the flashlight body between a raised and lowered position relative to the lantern body.

BRIEF DESCRIPTION OF THE DRAWINGS

Other objects and features of the present invention will become apparent from the following detailed description considered in connection with the accompanying drawings disclosing a preferred embodiment of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF THE PREFERRED EMBODIMENTS

Turning now in detail to the appended drawings, and, in particularly, FIGS. 1-4, therein illustrated is a novel dual-beam combination lantern-flashlight 10 embodying the present invention which includes two main components which form a closed loop handle design—namely a flashlight subassembly 20 and a lantern subassembly 30.

Figure 7:
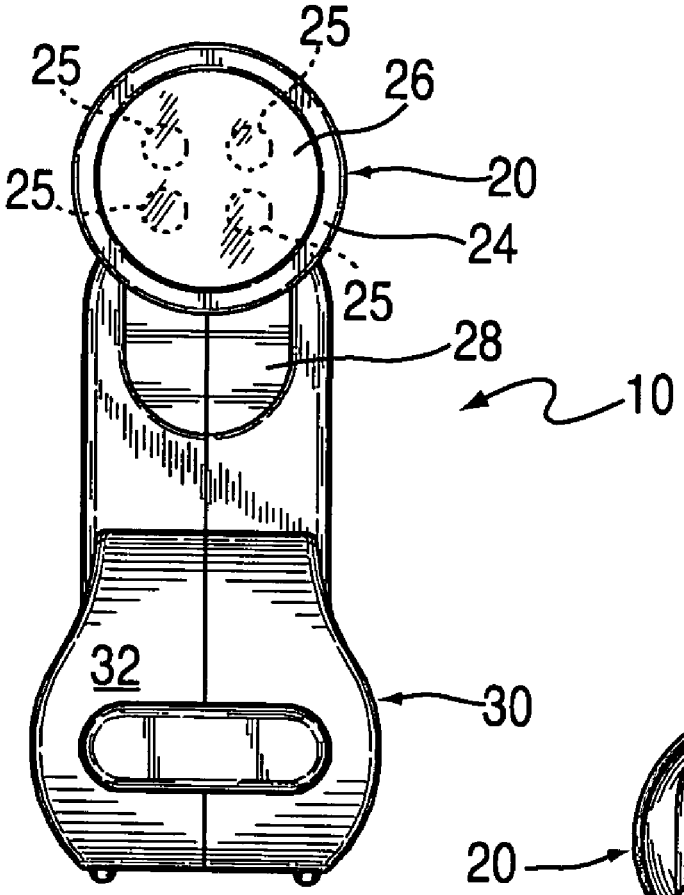
FIG. 7 is a front elevational view of the dual-beam lantern-flashlight.

Flashlight assembly 20 includes an elongated, flashlight body 22 having a race-track or oval cross-section which serves as a handle. The flashlight body 22 is covered with a multiplicity of spaced-apart ridges 23 which facilitate gripping. Flashlight body 22 has a removable front cap 24 threadably attached hereto which houses a primary headlamp composed of four LED lamps 25 arranged in cluster (see FIG. 7) disposed between a rear reflector (not shown) and a front lens 26. The flashlight body 22 is provided with two downward depending flanges or walls 28, 29 which define tracks by which flashlight body 22 is slidably mounted on lantern body 30 for movement between an up position (FIG. 3) and a down position (FIG. 4) as described in greater detail hereinafter.

As seen best in FIGS. 1, 2, 5, and 9, the lantern subassembly 30 includes an elongated relatively squat, lantern body 32 having a somewhat bulbous profile which houses an upper battery compartment 34 and a lower lamp compartment 36 in which is mounted a miniature thin florescent lamp 38, i.e., a cold cathode florescent lamp ("CCFL"), a reflector 40 mounted above the lamp and a rectangular clear lens 42 disposed therebelow through which the light of the lamp 38 projects. This lens 42 preferably has a light texture pattern for diffusion. Utilizing this diffuser provides the cold cathode fluorescent lighting lamp 38 for the downlight with exceptionally even or uniform illumination.

The lantern body 32 is provided with a pair of spaced-apart upstanding arms 44, 46, each of which is provided with a vertically or downwardly extending channel 48, 49, in which the flanges 28, 29 are respectively slidably coupled to allow for movement between said up (FIG. 3) and down (FIG. 4) positions of the flashlight body 22.

Lantern housing 30 also includes electrical components for operating the lamps, e.g., the printed circuit board to which various electronic components for operation of the lamps are mounted, including, e.g., DC/AC inverter (not shown). In particular and although not shown, the upper battery compartment 34 has metal contacts to which the wiring leads are connected for the four AA batteries 50 which power both LED lamp 25 and CCFL lamp 38. Although not shown, wiring from the lantern battery circuit is first routed up into the flashlight body through one of arms 44, 46 and connected to a four way slide switch 52 located on top of the flashlight body 22. From here, two sets of wire leads are routed out in two directions. One set of leads are routed to the LED lamps themselves and back to the batteries 50 in the lantern body 32. Another set is also routed out directly to the lantern 30 into the PCB and then the CCFL lamp 30 to power this lighting source for the downlight. The lantern body is further provided with an AC adapter (not shown) having an AC jack located behind each cover 39 (FIG. 8) to allow for AC operation as well.

Figure 6:
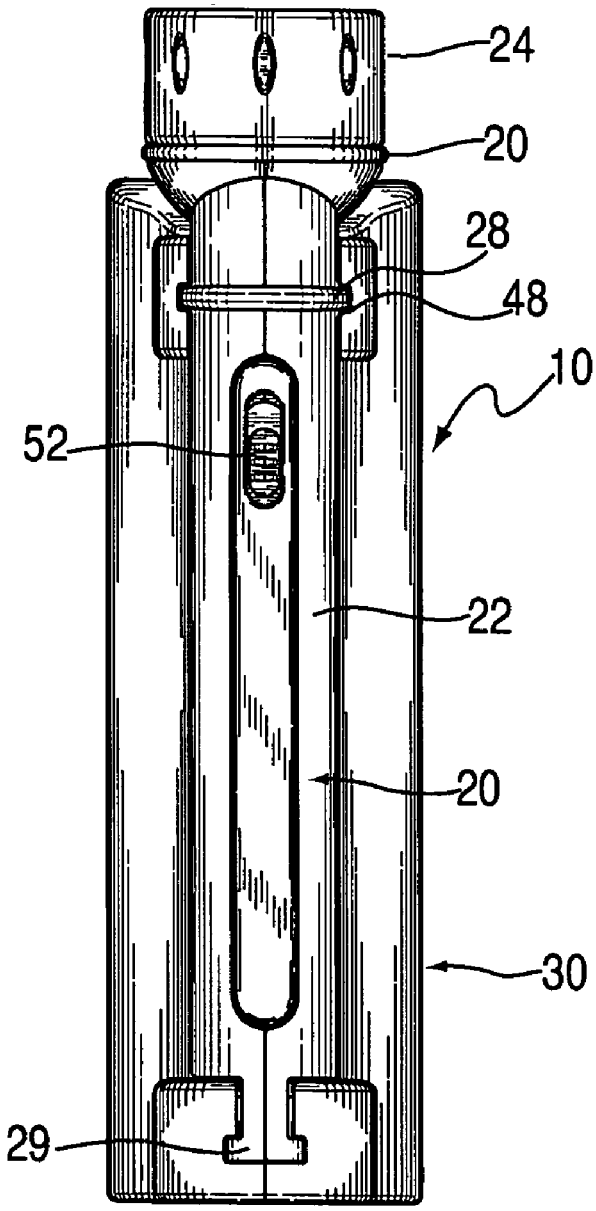
FIG. 6 is a top plan view of the dual-beam lantern-flashlight.
Figure 10:
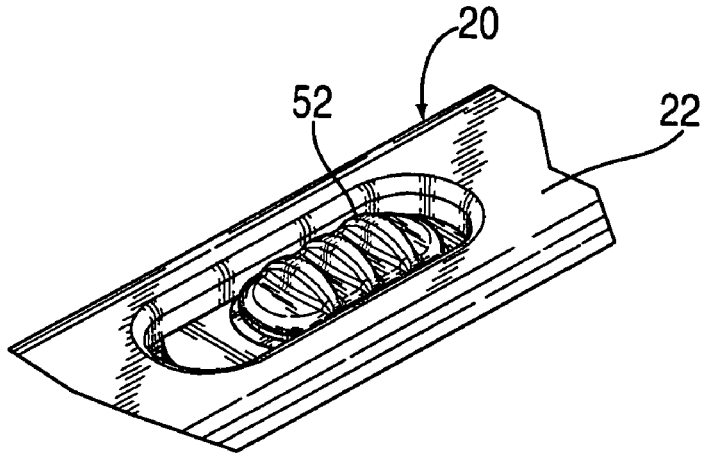
FIG. 10 is an enlarged, fragmentarily illustrated perspective view of the four way switch of the dual-beam lantern-flashlight.
Figure 11:
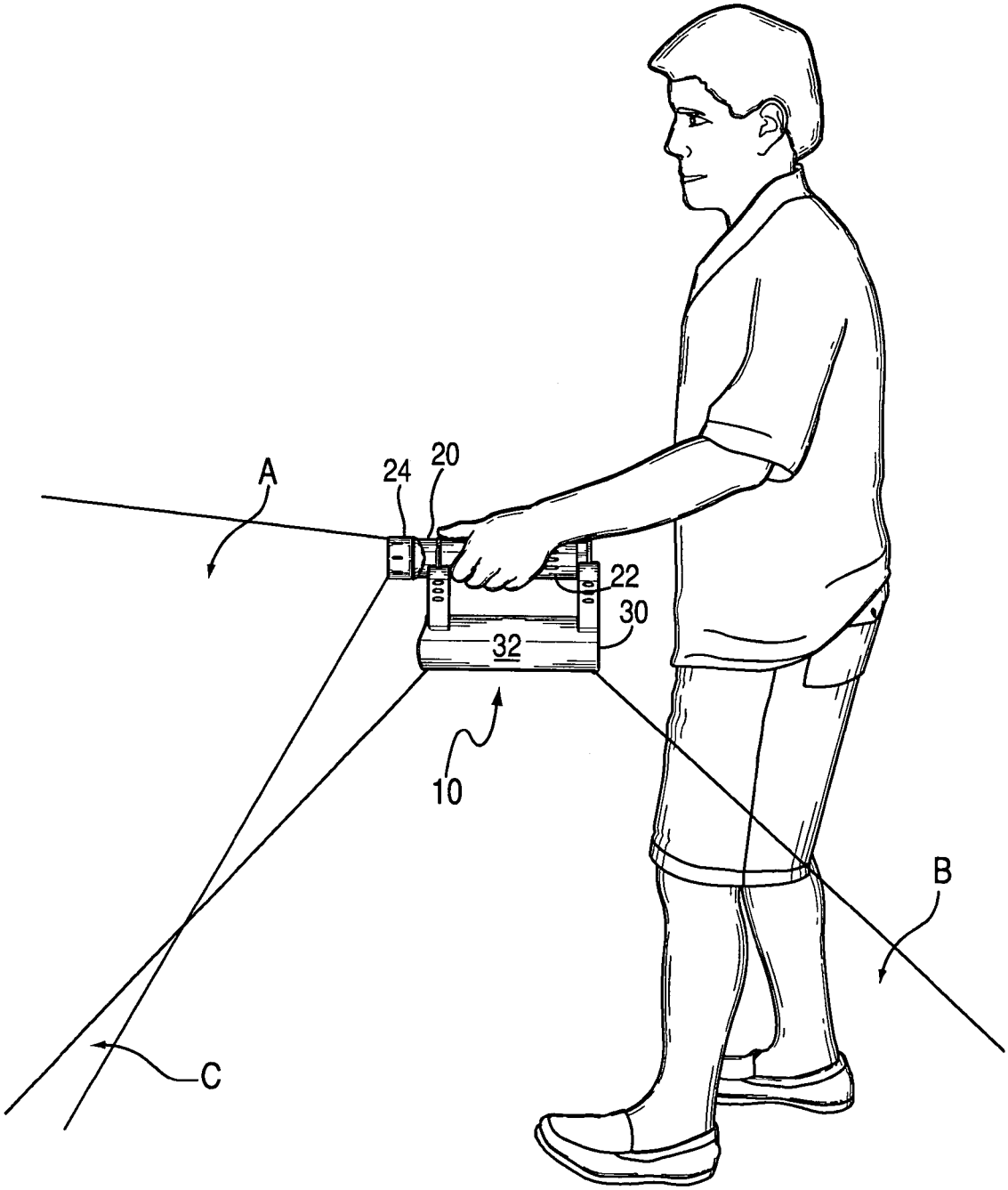
FIGS. 11 and 12 illustrate the area illuminated by the operator of both the primary and secondary lamp of the dual-beam lantern-flashlight.

As seen best in FIGS. 6 and 10, switch 52 which controls the various lighting modes is slidably movable between "off", "forward plus downlight", "forward only", and "downlight only" positions. For walking or hiking the preferred mode is (forward plus downlight) with the LED and CCFL lamps 25, 38 creating a single, large area of continuous light around the feet and forward of the user as shown in FIG. 11.

Figure 1:
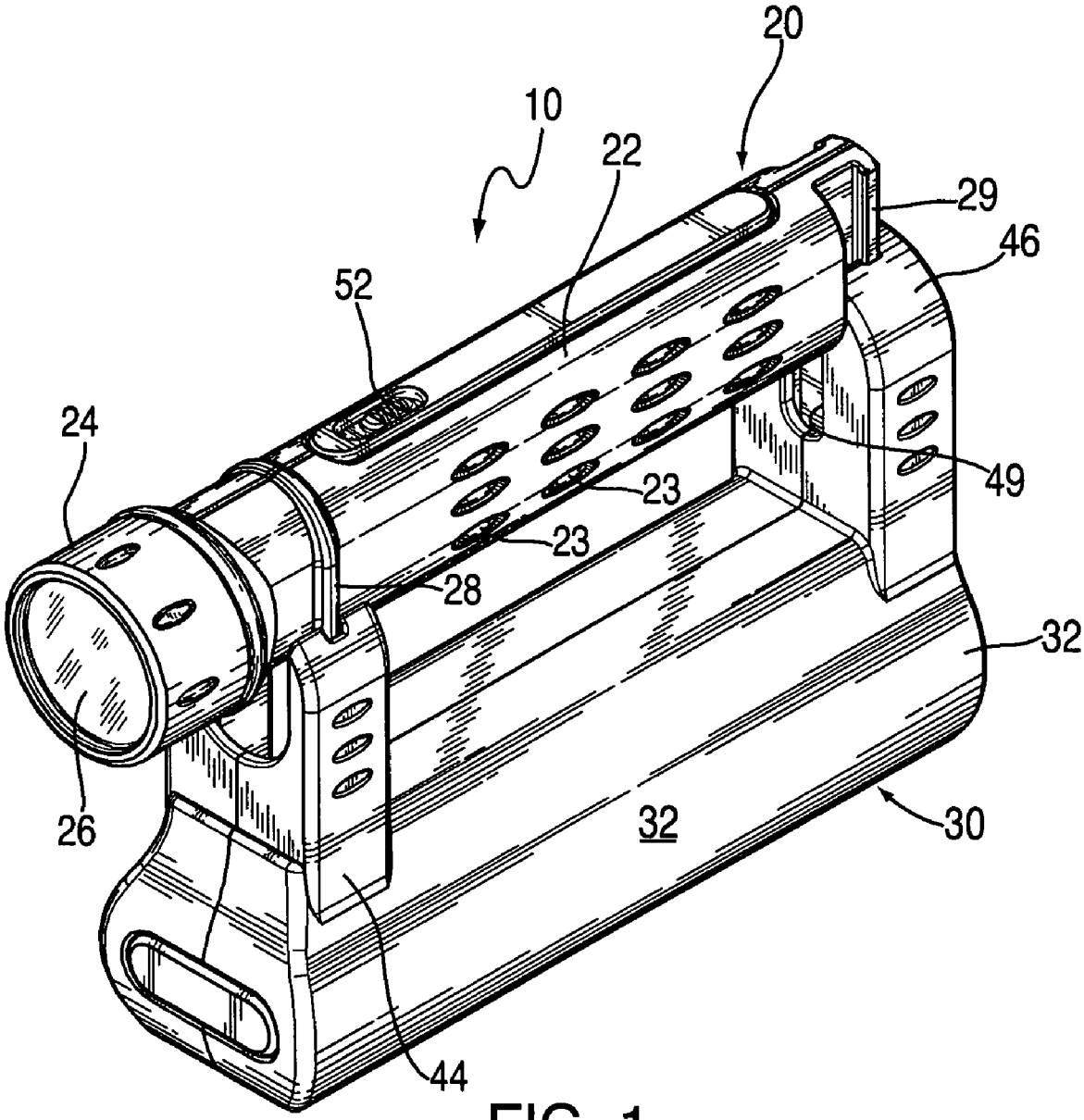
FIG. 1 is a perspective view of the dual-beam lantern-flashlight embodying the present invention with its handle in an "up" open position.
Figure 2:
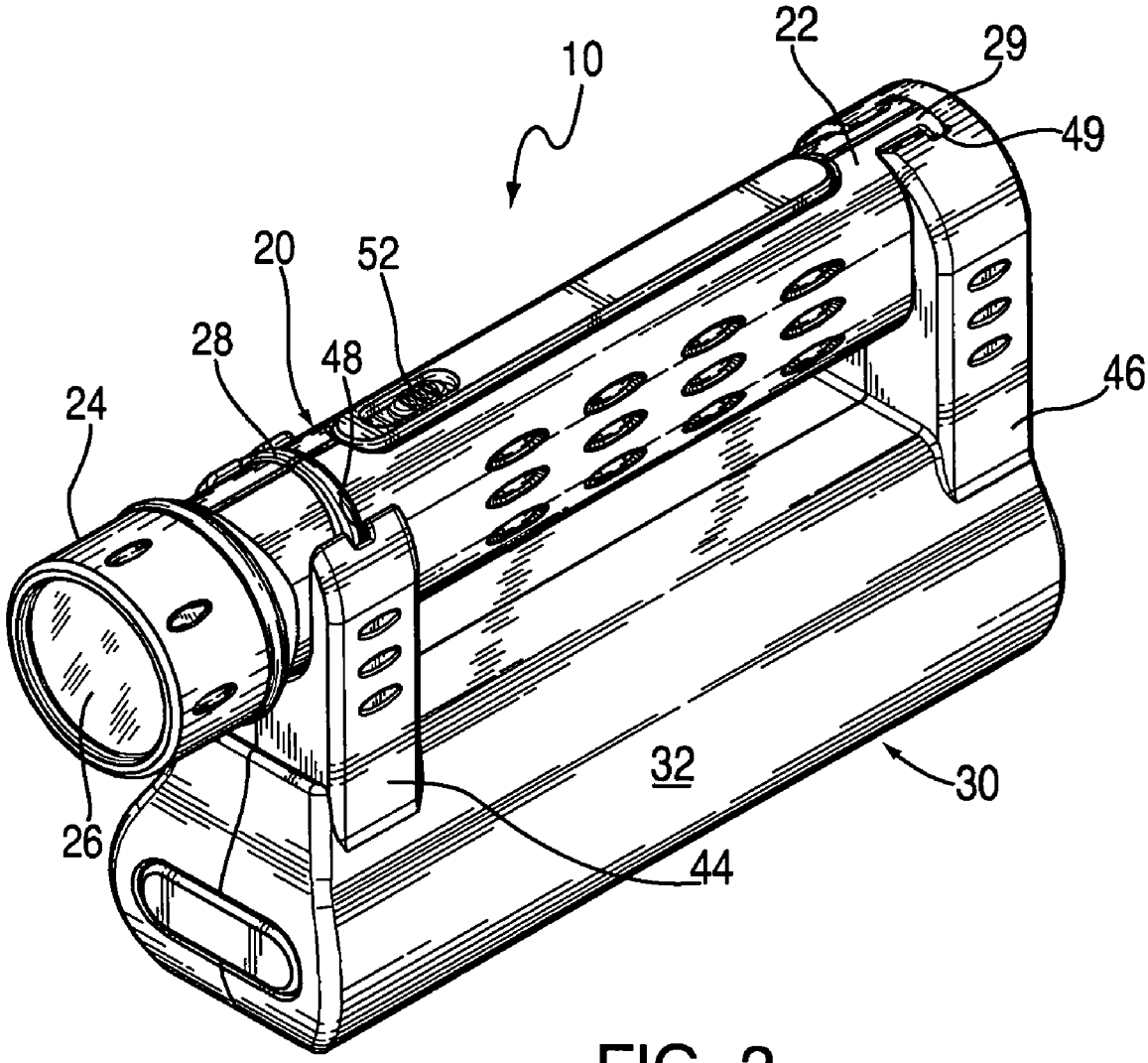
FIG. 2 is a perspective view of the dual-beam lantern-flashlight similar to that of FIG. 1 but with the handle in a "down" closed position.
Figure 3:
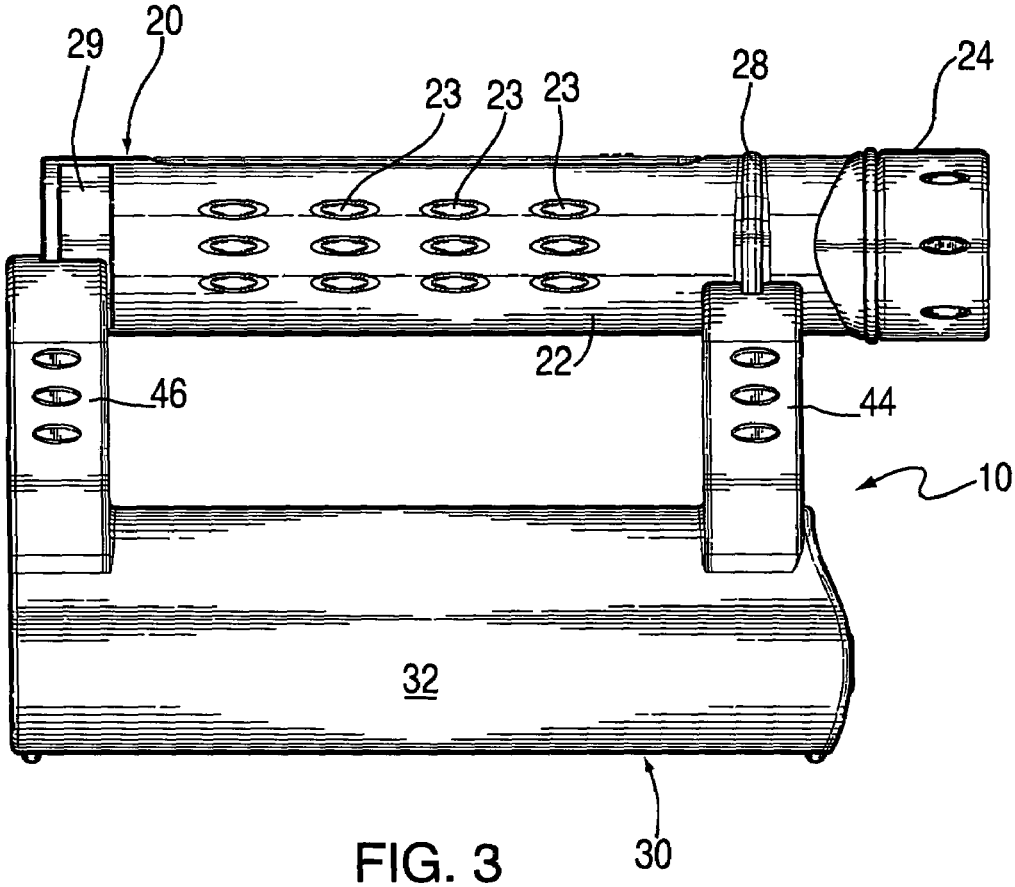
FIG. 3 is a side elevational view of the dual-beam lantern-flashlight in the "up" open handle position.
Figure 4:
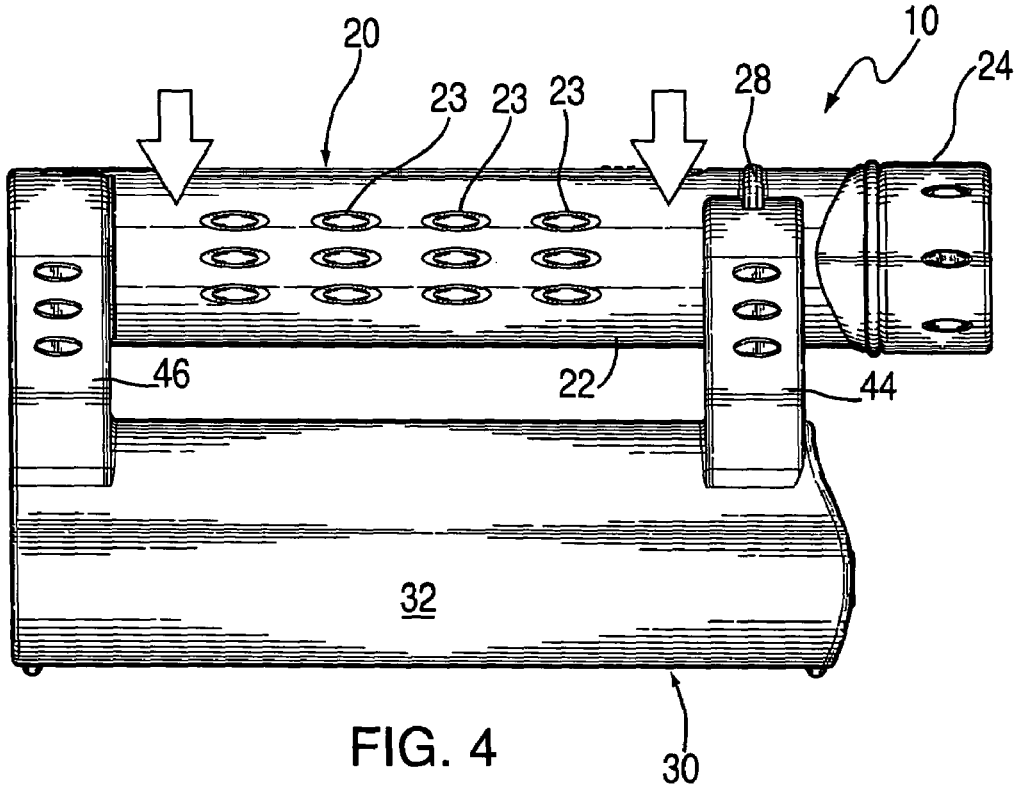
FIG. 4 is a side elevational view of the dual-beam lantern-flashlight in the "down" closed handle position.
Figure 5:
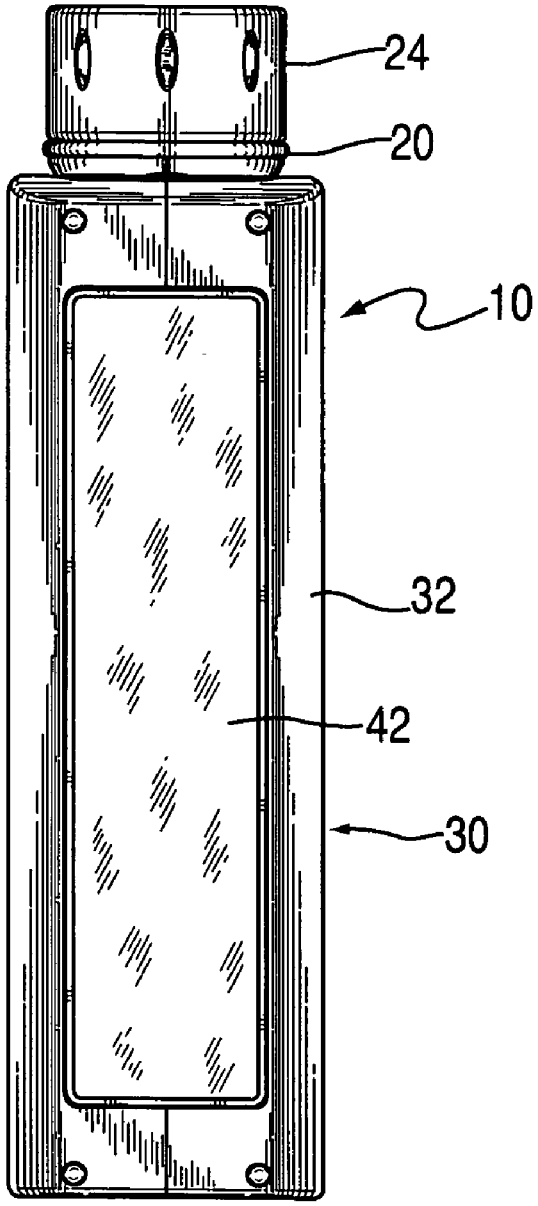
FIG. 5 is an bottom plan view of the dual-beam lantern-flashlight.
Figure 8:
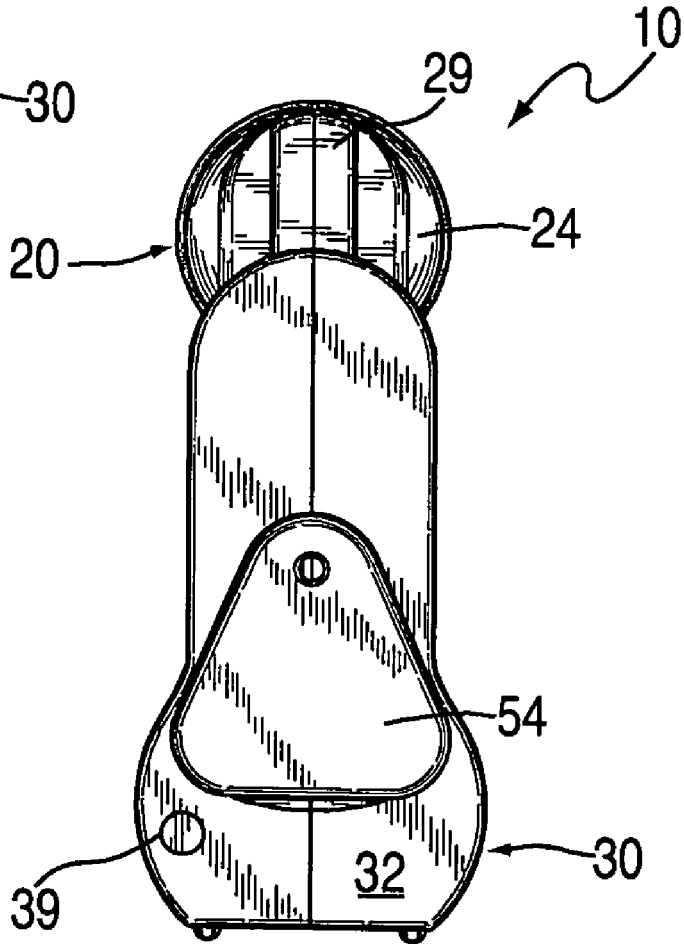
FIG. 8 is a rear elevational view of the dual-beam lantern-flashlight.

As can be seen from FIG. 8, the rear end of the flashlight lantern was relatively large footprint for applications where the light would be placed on its rear surface (e.g., for changing a car tire) (such as shown in FIG. 5). This large footprint provides a stable support even on uneven terrains and surfaces. By placing the unit on its rear side, the CCFL lighting source will be in an vertical orientation. In this mode, it is essentially the same as any other fluorescent lantern. FIG. 8 also illustrates the provision of a removably battery cover 54 for inserting, removing, and replacing batteries located on the rear side of the lamp housing.

Figure 9:
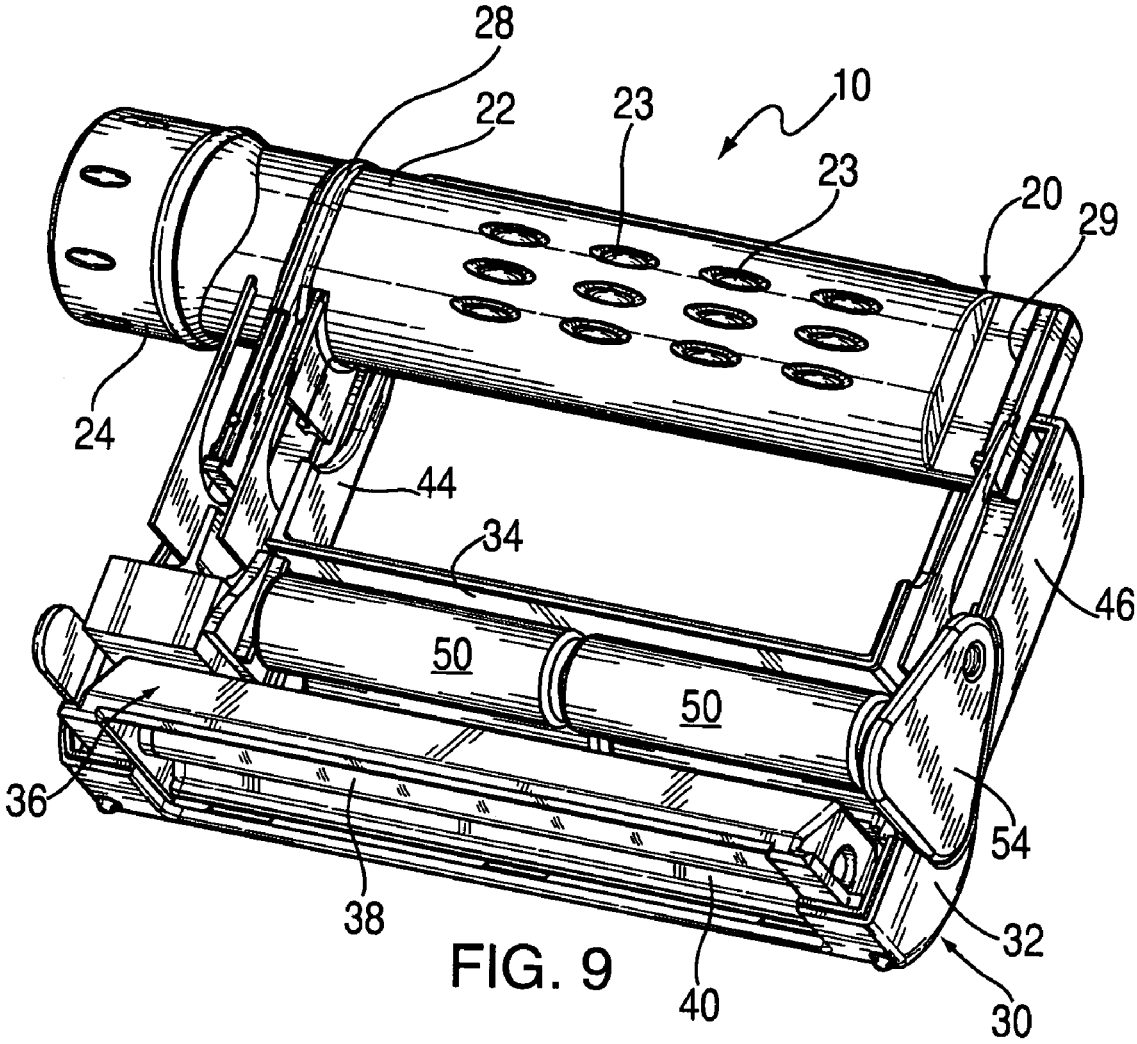
FIG. 9 is a fragmented perspective view of the lantern-flashlight with portions removed sliding to show interior construction.

As seen best in FIG. 9, the cold cathode fluorescent lamp is a miniature thin fluorescent lamp that outputs a tremendous amount of light for its size. Preferably, CCFL lamp is a 100 mm (approximately 4 inches in length)×2 mm diameter (0.080" tube).

The configuration of the LED's 25 may be of varying patterns. It is preferred, however, that the pattern be of a cluster format. In such cluster format, the four LED's 25 are able to combine their light output driving a light beam out to a useful distance of approximately sixty to seventy feet (see FIG. 12—light beam A). The LED's 25 project the beam through the clear thin lens cap 26 (i.e., flashlight lens). A switch 52 is provided on top of body 20 to operate the lantern-flashlight as discussed in greater detail hereinafter.

The four LED lamps 25 in cluster format for the headlamp affords one of the most energy efficient powered light sources used today. A single LED can typically be continuously on for up to forty (40) hours when powered by a single AA battery. The cold cathode fluorescent lamp 38 using the downlight is twice as energy efficient as an equivalent incandescent lighting source.

Figure 12:
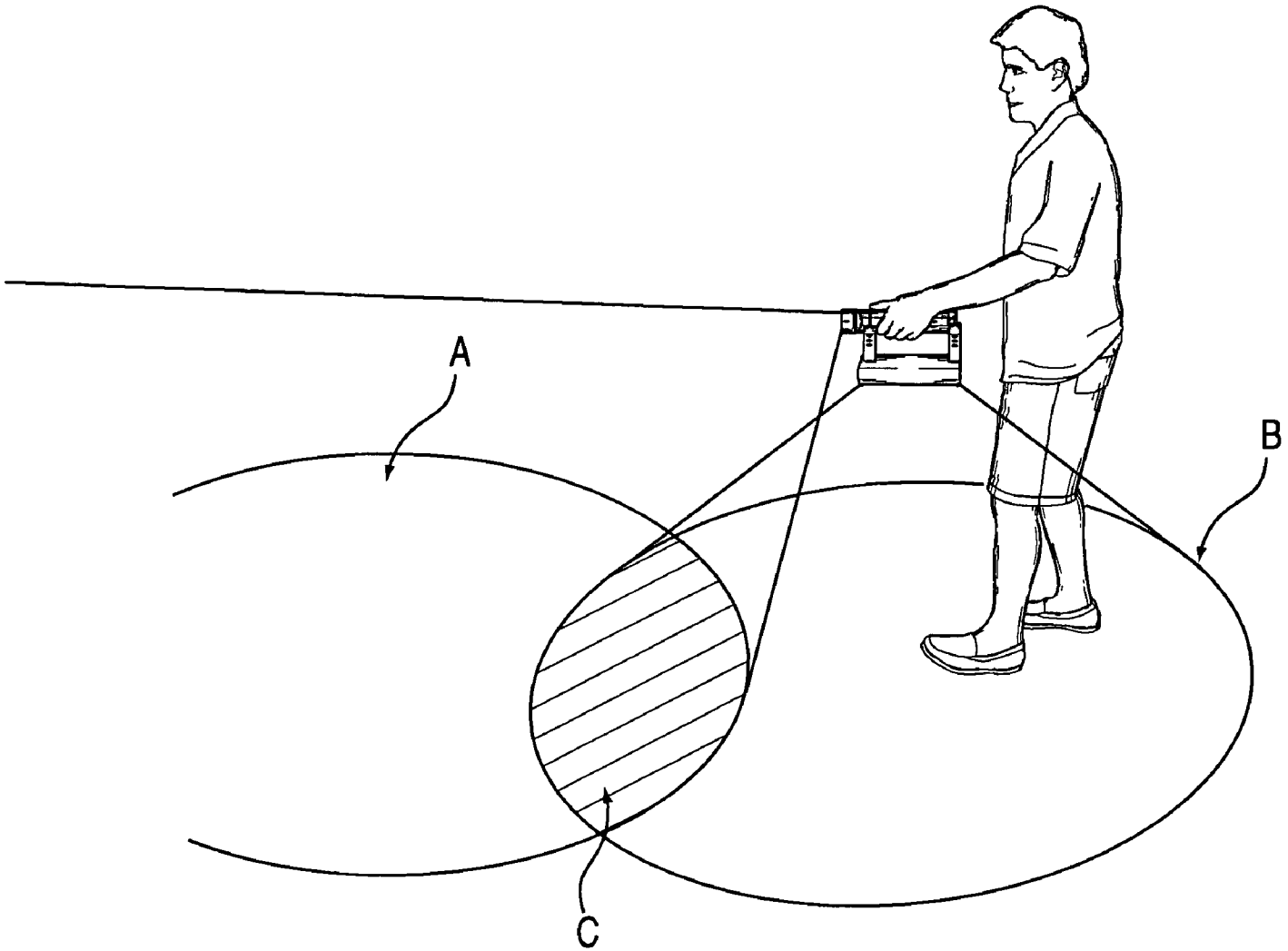

As seen best in FIGS. 11 and 12, the CCFL lamp 38 also illuminates a very large area at close range. Lamp 38 provides a region of even light around the user's feet (light beam B) of up to, e.g., a thirty (30) foot radius extending in all directions and behind the user as well with only a small shadow created by the user. The CCFL lamp 38 source provides even or uniform illumination which is far superior to a incandescent flashlight bulb.

As can be seen in FIGS. 11 and 12, the light beams A and B created by the four clustered LED's 25 in the headlamp 24 (beam A) and the single cold cathode fluorescent light 31 in the downlight (beam B) define an area C of overlap by which the beams A and B blend generally seamlessly together providing the user with a continuous lit area of up to sixty to seventy feet forward, and in a diameter of 30 feet around the user, which is extremely useful for hiking in dangerous terrain, or areas with dangerous animals, or in emergency situations (e.g., the aftermath of hurricane, tornadoes, earthquakes) where the user must negotiate through damaged and/or dangerous areas where the power is often out. This is also highly desirable for older people whose eyesight and/or night vision may already be impaired. In countless medical studies accidental falls by seniors can result in serious injury as seniors often live alone, making this dual-beam lantern-flashlight highly desirable for them.

Besides the energy efficiency previously mentioned, both. LED and cold cathode fluorescent lighting sources feature incredibly long lamp life. LED's are rated by manufacturers for up to 100,000 hours (although it is likely that the lamp life of LED's can conservatively be rated from a minimum of 20,000 to a maximum of 50,000 hours). Cold cathode fluorescent lamps are rated conservatively by most manufacturers from 10,000 to 20,000 hours. Neither of these lighting sources comprise filament construction, which means that with proper assembly design, both are far more shock resistant than incandescent lamps (e.g., LED's are used in many high impact consumer electronic products and for the same reason cold cathode fluorescent lamps are used to backlight LCD displays in laptop computers).

Other changes and modifications may be made as will be apparent to those skilled in the art. For example, due to the long life of LED's, the front cap 24 could instead be fixed. In certain applications, the LED's could be replaced and/or combined with an incandescent lamp such as a krypton, xenon, halogen or a vacuum bulb. Therefore, it is to be understood that the present invention is not limited to the sole embodiment described above, but encompasses any and all embodiments within the scope of the following claims.

What is claimed is:

1. A dual-beam lantern-flashlight capable of emitting two light beams, comprising:

an elongated flashlight body comprising a front end and a rear end;

a headlamp mounted on said front end of said body and disposed to emit a beam of light in a forward direction from said front end;

a lantern body coupled to said flashlight body, said lantern body having a bottom end; and a lantern lamp mounted in said bottom end of said lantern body and disposed to emit a beam of light generally downwardly and normally relative to the beam of light emitted by said headlamp, wherein said headlamp and lantern lamp when in use together create a single large area of continuous light around the feet and forward of the user, said beams of light emitted by said headlamp and lantern lamp defining an area of overlap by which said beams blend generally seamlessly together, wherein said flashlight body is slidably coupled to said lantern body for movement of said flashlight body between a raised and lowered position relative to said lantern body; and wherein said lantern body has a pair of spaced apart, upstanding arms having downwardly extending channels formed therein and wherein said flashlight body has a pair of spaced apart, downwardly extending flanges slidably received in said channels to allow movement of said flashlight body between a raised and lowered position relative to said lantern body.

2. The dual-beam lantern-flashlight according to claim 1, wherein said headlamp comprises at least one LED lamp.

3. The dual-beam lantern-flashlight according to claim 2, wherein said headlamp comprises four LED lamps arranged in a cluster pattern.

4. The dual-beam lantern-flashlight according to claim 3, wherein said lantern body has an upper battery compartment.

5. The dual-beam lantern-flashlight according to claim 4, wherein a removable battery cover is provided on the rear side of said lantern body for access to said battery compartment.

6. The dual-beam lantern-flashlight according to claim 1, wherein said lantern lamp comprises a cold cathode fluorescent lamp.

7. The dual-beam lantern-flashlight according to claim 6, wherein said lantern body further comprises a reflector mounted behind said lantern lamp and a lens mounted in front of said lantern lamp.

8. The dual-beam lantern-flashlight according to claim 7, wherein said lens has a light texture pattern for diffusion.

9. The dual-beam lantern-flashlight according to claim 1, wherein said head lamp comprises a front cap threadably receivable on said front end of said flashlight body, an LED lamp mounted in said cap, a reflector positioned behind said lamp and a lens mounted in said cap in front of said lamp.

10. The dual-beam lantern-flashlight according to claim 1, wherein a power switch is provided on said flashlight body for providing power to said headlamp and said lantern having a plurality of switch positions for enabling said headlamp and said lantern lamp to emit light individually or simultaneously.

11. A dual-beam lantern-flashlight capable of emitting two light beams, comprising:

an elongated flashlight body comprising a front end and a rear end;

a headlamp mounted on said front end of said body and disposed to emit a beam of light in a forward direction from said front end;

a lantern body coupled to said flashlight body, said lantern body having a bottom end;

a light source mounted in said bottom end of said lantern body and disposed to emit light generally downwardly and normally relative to the beam of light emitted by said headlamp; and means for supporting said flashlight body on said lantern body so as to allow for movement of said flashlight body between a raised and lowered position relative to said lantern body; and wherein said lantern body has an upstanding forward arm and an upstanding rear arm, wherein said forward and rear arms are spaced apart and each have downwardly extending channels formed therein to allow movement of said flashlight body between a raised and lowered position relative to said lantern body.

12. The dual-beam lantern-flashlight according to claim 11, wherein said headlamp comprises at least one LED lamp.

13. The dual-beam lantern-flashlight according to claim 12, wherein said headlamp comprises four LED lamps arranged in a cluster pattern.

14. The dual-beam lantern-flashlight according to claim 13, wherein said lantern body has an upper battery compartment.

15. The dual-beam lantern-flashlight according to claim 14, wherein a removable battery cover is provided on the rear side of said lantern body for access to said battery compartment.

16. The dual-beam lantern-flashlight according to claim 11, wherein said light source comprises a lantern lamp comprising a cold cathode fluorescent lamp.

17. The dual-beam lantern-flashlight according to claim 16, wherein said lantern body further comprises a reflector mounted behind said lantern lamp and a lens mounted in front of said lantern lamp.

18. The dual-beam lantern-flashlight according to claim 17, wherein said lens has a light texture pattern for diffusion.

19. The dual-beam lantern-flashlight according to claim 11, wherein said head lamp comprises a front cap receivable on said front end of said flashlight body, at least one LED lamp mounted in said cap, a reflector positioned behind said lamp and a lens mounted in said cap in front of said lamp.

20. The dual-beam lantern-flashlight according to claim 11, wherein a power switch is provided on said flashlight body for providing power to said headlamp and said lantern having a plurality of switch positions for enabling said headlamp and said lantern lamp to emit light individually or simultaneously.

21. The dual-beam lantern flashlight according to claim 11, wherein said headlamp and lantern lamp when is use together create a single large area of continuous light around the feet and forward of the user, said beams of light emitted by said headlamp and lantern lamp defining an area of overlap by which said beams blend generally seamlessly together.

22. The dual-beam lantern-flashlight according to claim 11, wherein at least a portion of said flashlight body is covered with a multiplicity of spaced-apart ridges which facilitate gripping.

23. The dual-beam lantern-flashlight according to claim 11, wherein said rear arm has a flat rear wall, and wherein said lantern body has a flat rear wall aligned and disposed flush with said flat rear wall of side rear arm.

24. The dual-beam lantern-flashlight according to claim 11, wherein said upstanding forward arm defines a yoke in which a portion of said elongated flashlight body generally adjacent to said front end thereof is slidably received when in said lowered position.

25. A dual-beam lantern-flashlight capable of emitting two light beams, comprising:

an elongated flashlight body comprising a front end and a rear end and having a pair of spaced apart downwardly extending flanges;

a headlamp mounted on said front end of said body and disposed to emit a beam of light in a forward direction from said front end;

a lantern body coupled to said flashlight body, said lantern body having a bottom end, and a pair of spaced-apart, upstanding arms having downwardly extending channels formed therein and wherein said pair of spaced-apart, downwardly extending flanges of said flashlight body are each slidably received in one of said channels to allow movement of said flashlight body between a raised and lowered position relative to said lantern body; and a lantern lamp mounted in said bottom end of said lantern body and disposed to emit a beam of light generally downwardly and normally relative to the beam of light emitted by said headlamp, wherein said headlamp and lantern lamp when in use together create a single large area of continuous light around the feet and forward of the user, said beams of light emitted by said headlamp and lantern lamp defining an area of overlap by which said beams blend generally seamlessly together.

26. A dual-beam lantern-flashlight capable of emitting two light beams, comprising:

an elongated flashlight body comprising a front end and a rear end;

a headlamp mounted on said front end of said body and disposed to emit a beam of light in a forward direction from said front end;

a lantern body coupled to said flashlight body, said lantern body having a bottom end;

a light source mounted in said bottom end of said lantern body and disposed to emit light generally downwardly and normally relative to the beam of light emitted by said headlamp; and means for supporting said flashlight body on said lantern body so as to allow for movement of said flashlight body between a raised and lowered position relative to said lantern body;

wherein said lantern body has an upstanding forward arm and an upstanding rear arm, wherein said forward and rear arms are spaced apart and each have downwardly extending channels formed therein to allow movement of said flashlight body between a raised and lowered position relative to said lantern body and wherein said rear arm has a flat rear wall, and wherein said lantern body has a flat rear wall aligned and disposed flush with said flat rear wall of side rear arm.

27. A dual-beam lantern-flashlight capable of emitting two light beams, comprising:

an elongated flashlight body comprising a front end and a rear end;

a headlamp mounted on said front end of said body and disposed to emit a beam of light in a forward direction from said front end;

a lantern body coupled to said flashlight body, said lantern body having a bottom end;

a light source mounted in said bottom end of said lantern body and disposed to emit light generally downwardly and normally relative to the beam of light emitted by said headlamp; and means for supporting said flashlight body on said lantern body so as to allow for movement of said flashlight body between a raised and lowered position relative to said lantern body;

wherein said lantern body has an upstanding forward arm and an upstanding rear arm, wherein said forward and rear arms are spaced apart and each have downwardly extending channels formed therein to allow movement of said flashlight body between a raised and lowered position relative to said lantern body, wherein said rear arm has a flat rear wall, and wherein said lantern body has a flat rear wall aligned and disposed flush with said flat rear wall of side rear arm and wherein said upstanding forward arm defines a yoke in which a portion of said elongated flashlight body generally adjacent to said front end thereof is slidably received when in said lowered position.

* * * * *